US005753398A

United States Patent [19]

Mizoguchi

[11] Patent Number: 5,753,398

[45] Date of Patent: May 19, 1998

[54] DEVELOPING METHOD USING TRANSFER VOLTAGE AND BACK-TRANSFER VOLTAGE

[75] Inventor: Yoshito Mizoguchi, Kawasaki, Japan

[73] Assignee: Canon Kabushiki Kaisha, Tokyo, Japan

[21] Appl. No.: 554,982

[22] Filed: Nov. 13, 1995

[30] Foreign Application Priority Data

Nov. 11, 1994 [JP] Japan ..... 6-277834
Nov. 11, 1994 [JP] Japan ..... 6-301636

[51] Int. Cl.[6] ..... G03G 13/08

[52] U.S. Cl. ..... 430/102; 430/120

[58] Field of Search ..... 430/103, 120

[56] References Cited

U.S. PATENT DOCUMENTS 4,527,884 7/1985 Nusser ..... 430/103
4,707,428 11/1987 Terao et al. ..... 430/103
5,307,127 4/1994 Kobayashi et al. ..... 430/120

*Primary Examiner*—John Goodrow
*Attorney, Agent, or Firm*—Fitzpatrick, Cella, Harper & Scinto

[57] ABSTRACT

A developing method includes the steps of: applying for a predetermined duration $t_1$ to a developer carrying member, faced to an image bearing member for bearing an electrostatic image before formation of a developed image, for carrying a developer, a back-transfer voltage $V_1$ for returning the developer to the developer carrying member; applying for a predetermined duration $t_2$ to the developer carrying member a transfer voltage $V_2$ for transferring the developer from the developer carrying member to the image bearing member; shifting from the back-transfer voltage $V_1$ to the transfer voltage $V_2$ substantially in rectangular profile; and shifting from the transfer voltage $V_2$ to the back-transfer voltage $V_1$, taking a predetermined duration $t_3$.

15 Claims, 14 Drawing Sheets

DEVELOPING METHOD USING TRANSFER VOLTAGE AND BACK-TRANSFER VOLTAGE

FIELD OF THE INVENTION AND RELATED ART

The present invention relates to a developing method for developing an electrostatic image on an image bearing member, usable with an image forming apparatus, such as an electrophotographic apparatus or an electrostatic recording apparatus.

In an electrophotographic type image forming apparatus, an electrostatic latent image formed on an image bearing member is developed by a developing device into a visualized toner image. Referring first to FIG. 6, there is shown a major part of an example of an image forming apparatus provided with a conventional developing device.

The present image forming apparatus is provided with a photosensitive drum 1 having a photosensitive layer as an image bearing member. In this example, the photosensitive drum 1 has a diameter of 80 mm, and is rotated in the direction of the arrow in the figure at a speed of 320 mm per sec. During the rotation, the surface is charged uniformly to 400V by a primary charger. Subsequently, the photosensitive drum 1 is exposed to image light bearing image information by a light emission element, such as laser or LED, so that an electrostatic latent image is formed on the photosensitive drum 1. The electrostatic latent image formed on the photosensitive drum 1 is developed by a developing device disposed adjacent to the photosensitive drum 1.

In a developing container 5 containing a magnetic toner as the developer, there are provided a developing sleeve 2, a magnet roller 3 and a magnetic blade 4. The developing sleeve 2 has a diameter of 25 mm, and is disposed in an opening facing to the photosensitive drum 1 for rotation in the direction indicated by the arrow. In the developing sleeve 2, a magnet roller 3 is stationarily disposed.

The developing sleeve 2 carries the toner to a developing zone where it faces the photosensitive drum 1, and the thickness of the toner is regulated by the magnetic blade 4 so that a toner layer of predetermined thickness is formed on the developing sleeve 2.

The thin layer of the toner thus formed on the developing sleeve 2 is rubbed with the magnetic blade 4 and the developing sleeve 2 to acquire a charge of −10 μC/g.

The photosensitive drum 1 and the developing sleeve 2 are disposed with a gap of 50–500 μm therebetween in the developing zone. Between the developing sleeve 2 and photosensitive drum 1 (SD gap), a developing bias is produced in the form of superposed DC voltage and AC voltage, having a frequency of 1 kHz–8 kHz, an amplitude of 40–3000V, and an integrated average Vdc of 50–300V, thereby creating a developing electric field.

As the AC voltage, a sine wave, a triangular wave, a saw teeth wave, a rectangular wave, and a so called DUTY bias, which is a bias wherein ½ the value of the peak-to-peak voltage is different from integrated average Vdc, are known.

Charged toner on the developing sleeve 2 is shifted from the surface of the developing sleeve 2 to the surface of the photosensitive drum 1 by the force applied by the developing electric field in the developing zone, so that regular development of the electrostatic latent image is effected on the photosensitive drum 1.

It is known that with the same peak-to-peak voltage (Vpp), the image density is improved by a using rectangular wave in place of a sine wave or a triangular wave, or the like.

FIG. 5 shows waveforms leaving the same Vpp and the potential of the photosensitive member. In the examples, the SD gap is 200 μm. The image portion $V_D$ is developed by the potential difference $1V_D$-Vminl between the photosensitive member potential $V_D$ and the Vmin. Actually, however, the toner having a potential is deposited on the developing sleeve by a mirror force, so that the toner departs the sleeve when a potential difference exceeding a certain level occurs by overcoming the mirror force. The potential of the threshold is not correctly known. However, when the toner triboelectric charge is approximately −10 μC/g, the toner jumps when the field intensity exceeds 1–2V/μm, and therefore, when the S-D Gap is approximately 200 μm, the threshold is slightly larger than approximately 200V. With a threshold of 250V, development occurs when the difference from $V_D$ is not less than 250V and, it is effected by a force corresponding to the area of a region B in FIG. 5.

When the areas of the B portions are compared, they are 2:½π; π−2; 1.57:3.14 for sine wave/triangular wave/rectangular wave. If the Vpp is the same, a rectangular wave provided the largest area, and therefore, a sufficient density is provided thereby.

However, when the rectangular wave is used, there arises a problem of an increase in the reverse charge fog.

The phrase "reverse charge fog" indicates that tone, charged to a polarity opposite from the polarity of regular charged toner, is deposited on the $V_C$ portion in the back transfer phase, as to the regular toner, of the development AC bias (Vmax side).

If the voltage at which the reversely charged toner starts to jump is 250V again, the reversely charged toner is deposited on the $V_C$ portion by a force corresponding to the area of the region indicated by A in FIG. 5. So, for the very same reason that the density improves by replacing the sine wave with a rectangular wave, the reverse charge fog is increased.

Of course, if a sine wave is used, the reverse charge fog is decreased, but then, the density becomes insufficient. Even if an attempt is made to increase the density by increasing the peak-to-peak voltage of an alternate waveform while keeping the sine wave form, leakage occurs at a low voltage, and therefore, there is a limit in increasing the Vpp.

It is known that uniformity of image quality, particularly that of a half-tone image, is improved by using a duty bias in place of a rectangular wave.

Referring to FIG. 8, this will be described. In FIG. 8, the potential of the photosensitive member is indicated on the ordinate. Designated by $V_D$ is a dark potential of the photosensitive member, which is developed into a solid black. Designated by $V_L$ is a light potential and does not receive the toner. The portion of $V_H$ therebetween has a half-tone potential, which is developed to a half-tone gray in response to the different voltage from the developing bias $V_{DC}$ (200V in the figure).

The optical system for providing the potential relation of the half-tone, is not limited to an analog optical system but includes a digital optical system.

This is because, except for a half-tone image, an image is formed using a complete area tone gradient, and a bi-level potential relation is difficult to accomplish even if the use is made of a digital optical system, and a half-tone image is realized using a difference in the exposure amount with intensity modulation. This is more remarkable with the recent improvement of the resolution (diameter reduction of the spot diameter of the laser or the like).

A comparison will be made between a rectangular wave and a duty wave in the developing bias when the half-tone potential is developed. In FIG. 8, the wave line indicates a rectangular wave, and a duty wave of 35% is indicated by a one point wave line. A 35% duty wave is defined as a rectangular wave wherein the time period in which the potential is in the development promoting side beyond the $V_{DC}$ is 35% of the one period.

As will be understood from the figure, in the case of a rectangular wave, the developing electric field and the development time are $V_{H\text{-}sqr}$ and $t_{H\text{-}sqr}$, respectively, but in the case of a duty wave, they are $V_{H\text{-}duty}$ and $t_{H\text{-}duty}$, respectively.

Here, the duty wave can be such that $V_{H\text{-}sqr}<V_{H\text{-}duty}$ and $t_{H\text{-}sqr}>t_{H\text{-}duty}$, are satisfied, by which uniform half-tone development is accomplished, as is known.

The reason for this is that the toner triboelectric charge on the developing sleeve is not sufficiently uniform but involves a distribution.

When the use is made of a duty wave, a half-tone image is developed in a shorter period and with a higher electric field than a rectangular wave, and the toner developing the half-tone image is a relatively high triboelectric charge toner. So, the deposition force to the drum is increased, and therefore, the toner image on the drum is not easily disturbed, thus permitting uniform half-tone development to be accomplished.

The developing electric field for developing the $V_D$ potential, and the development time is $V_{D\text{-}sqr}$ and $t_{D\text{-}sqr}$, and is $V_{D\text{-}duty}$ and $t_{D\text{-}duty}$ for duty bias.

However, when use is made of the conventional example duty bias and when the toner triboelectric charge on the developing sleeve is low, no sufficient image density is provided, and the uniformity of the half-tone image is insufficient. This is particularly remarkable under the condition that the toner triboelectric charge is low, as in the case that the used toner is magnetic toner having leakage site such as magnetite or the like, that the temperature is high, or that the apparatus is started after a relatively long term non-use of the apparatus.

The reason for the insufficiency of the density is that the development time $t_{D\text{-}duty}$ of the duty bias for developing the $V_D$ portion described in FIG. 8 is short, and therefore, a toner of the low triboelectric charge does not easily reach the drum.

When the bias approaches a rectangular wave to increase the length of the $t_{D\text{-}duty}$, the density tends to increase, but the uniformity of a half-tone image decreases.

It has been considered that a low triboelectric charged toner be used with the duty bias, but the uniformity of the half-tone is not sufficient for the following reasons.

FIG. 9 is a graph provided by extracting the potential relation among $V_D$, $V_H$ and $V_L$ and the duty bias only.

With the electric field $V_{H\text{-}duty}$, the toner pops out from the developing sleeve to the $V_H$ against the mirror force with the sleeve, and it receives the electric field directed toward the drum, and reaches the drum during $t_{H\text{-}duty}$.

After the change of the AC bias, the toner is going to be removed from the drum. When the electric field between the $V_H$ portion and the drum exceeds a predetermined degree, the toner once deposited on the drum overcomes the mirror force to jump back to the sleeve.

When the toner triboelectric charge is high the situation is as follows. When the difference from $V_H$ exceeds 200V, and the toner is going to jump out from the drum, the toner jumps back to the sleeve if the bias is higher than the threshold bias $V_{th1}$. Therefore, in the region I as indicated by dotted areas in the figure, the toner returns to the sleeve by a force corresponding to the area of this region.

When, on the other hand, the toner triboelectric charge is low, the threshold is low, and therefore, if it is assumed that when the difference becomes 125V, for example, the toner jumps from the drum, the toner return to the sleeve by a force corresponding to the region (hatched lines) in which the potential is higher than $V_{th2}$. As understood, the region II indicated by hatched lines only is larger than the dotted region I in the area. Therefore, in the low triboelectric charge case, the toner having developed the $V_H$ portion, easily returns from the drum. For this reason, the uniformity of the half-tone image is not sufficient even if the duty bias is used.

If an attempt is made to use a bias indicated by the wave line of FIG. 9 by increasing the duty to improve the uniformity of the half-tone image, the area of hatched lines region III indicated by the broken line can be decreased, so that the uniformity of the half-tone portion is improved. But, then, the density tends to decrease for the reasons previously stated.

In the case in which the low triboelectric charge toner is used, the density and the uniformity of the half-tone portion are not sufficient even if the duty bias is used. From the standpoint of density, the rectangular wave is advantageous, but the uniformity of the half-tone portion is poor. Conversely the duty bias is preferable for achieving uniformity of the half-tone portion, but then, the density is not sufficient.

SUMMERY OF THE INVENTION

Accordingly, it is a principle object of the present invention to provide a developing method with which a high density image is provided by a small Vpp and with suppressed reverse charge fog.

It is another object of the present invention to provide a developing method wherein a high density image is produced as is uniformity of the half-tone image.

According to an aspect of the present invention, there is provided a developing method comprising the steps of: applying for a predetermined duration $t_1$ to a developer carrying member, facing an image bearing member for bearing an electrostatic image before formation of a developed image and for carrying a developer, a back-transfer voltage $V_1$ for returning the developer to the developer carrying member; applying for a predetermined duration $t_2$ to the developer carrying member a transfer voltage $V_2$ for transferring the developer from the developer carrying member to the image bearing member; shifting from the back-transfer voltage $V_1$ to the transfer voltage $V_2$ substantially in a rectangular profile; and shifting from the transfer voltage $V_2$ to the back-transfer voltage $V_1$, taking a predetermined duration $t_3$.

According to another aspect of the present invention, there is provided a developing method comprising the steps of: applying to a developer carrying member, facing an image bearing member for bearing an electrostatic image before formation of a developed image and for carrying a developer, a back-transfer voltage $V_1$ for returning the developer to the developer carrying member; applying to the developer carrying member a transfer voltage for transferring the developer from the developer carrying member to the image bearing member; wherein the duration for the transfer voltage to develop a low density portion is less than 50% of a period T of a voltage applied to the developer carrying member, and a duration for developing a high density portion is not less than 50% of the period T.

These and other objects, features and advantages of the present invention will become more apparent upon a consideration of the following invention taken in conjunction with the accompanying drawings.

DESCRIPTION OF THE PREFERRED EMBODIMENT

Referring to the accompanying drawings, the embodiments of the present invention will be described.

Figure 6:
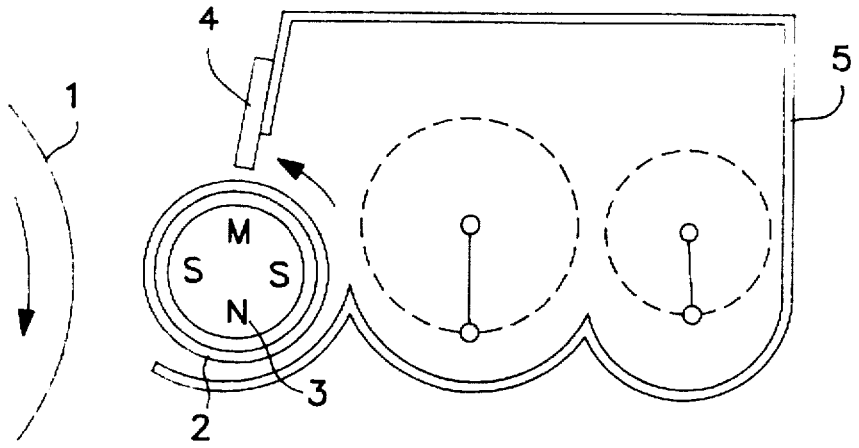
FIG. 6 shows a major part of an image forming apparatus used in the present invention.
Figure 7:
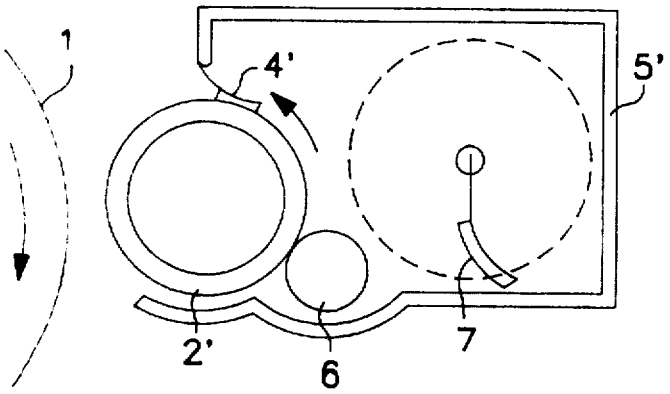
FIG. 7 shows a major part of another image forming apparatus used in this invention.
Figure 8:
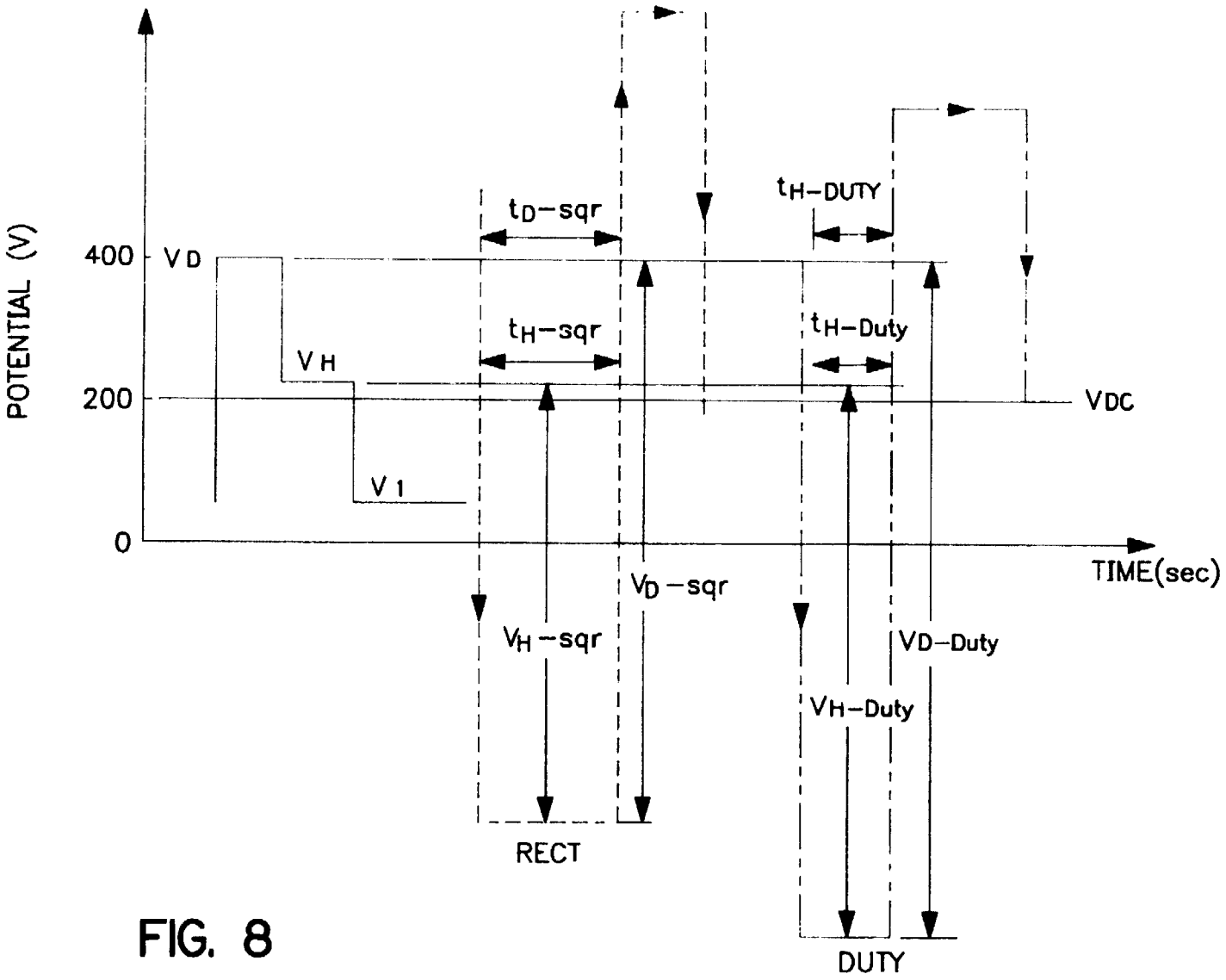
FIG. 8 shows a developing bias in a conventional example.

FIG. 7 is a sectional view of a developing device usable with an embodiment of the present invention, and the same reference numerals as in FIG. 6 are assigned to the elements having the corresponding functions, and detailed descriptions thereof are omitted for simplicity.

The developing method of the present invention is applicable to the device of FIG. 6.

In the figures, designated by 1 is an image bearing member having an amorphous silicon photosensitive layer; 5' denotes a developing container for accommodating a non-magnetic toner; 7 denotes a stirring transportation plate 2' denotes a developing roller; 6 is a supply roller for supplying the toner to the developing roller; and 4' denotes an elastic blade.

(First embodiment)

Figure 1:
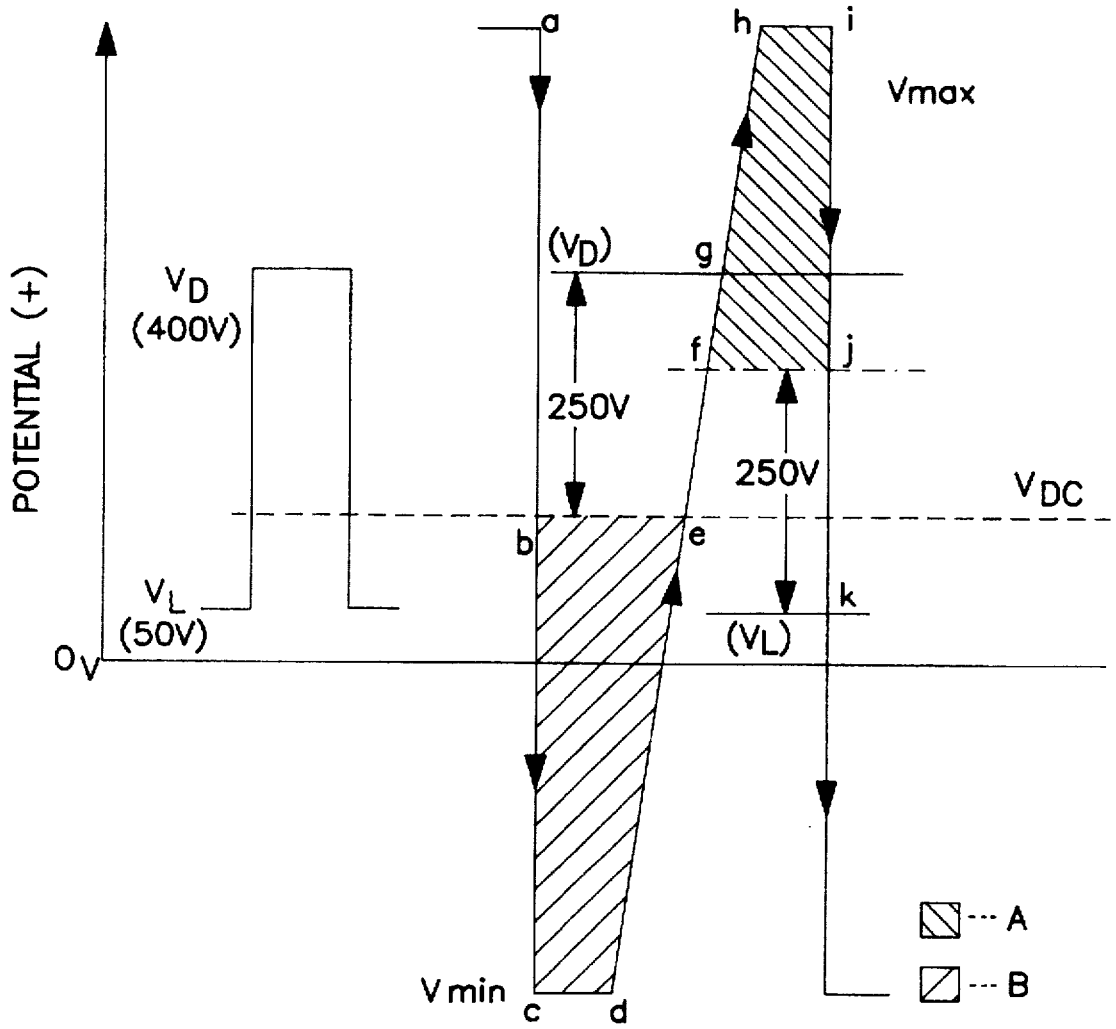
FIG. 1 describes a as voltage used in a first embodiment of the present invention.

FIG. 1 shows a waveform of a developing bias applied to the developer carrying member.

The shown bias is such that the change from Vmax to Vmin is effected in a substantially rectangular profile (as in rectangular wave), and the rising to the Vmax side (back-transferring side) is in a dull shape. This will be called hereinafter "slope bias".

Figure 5:
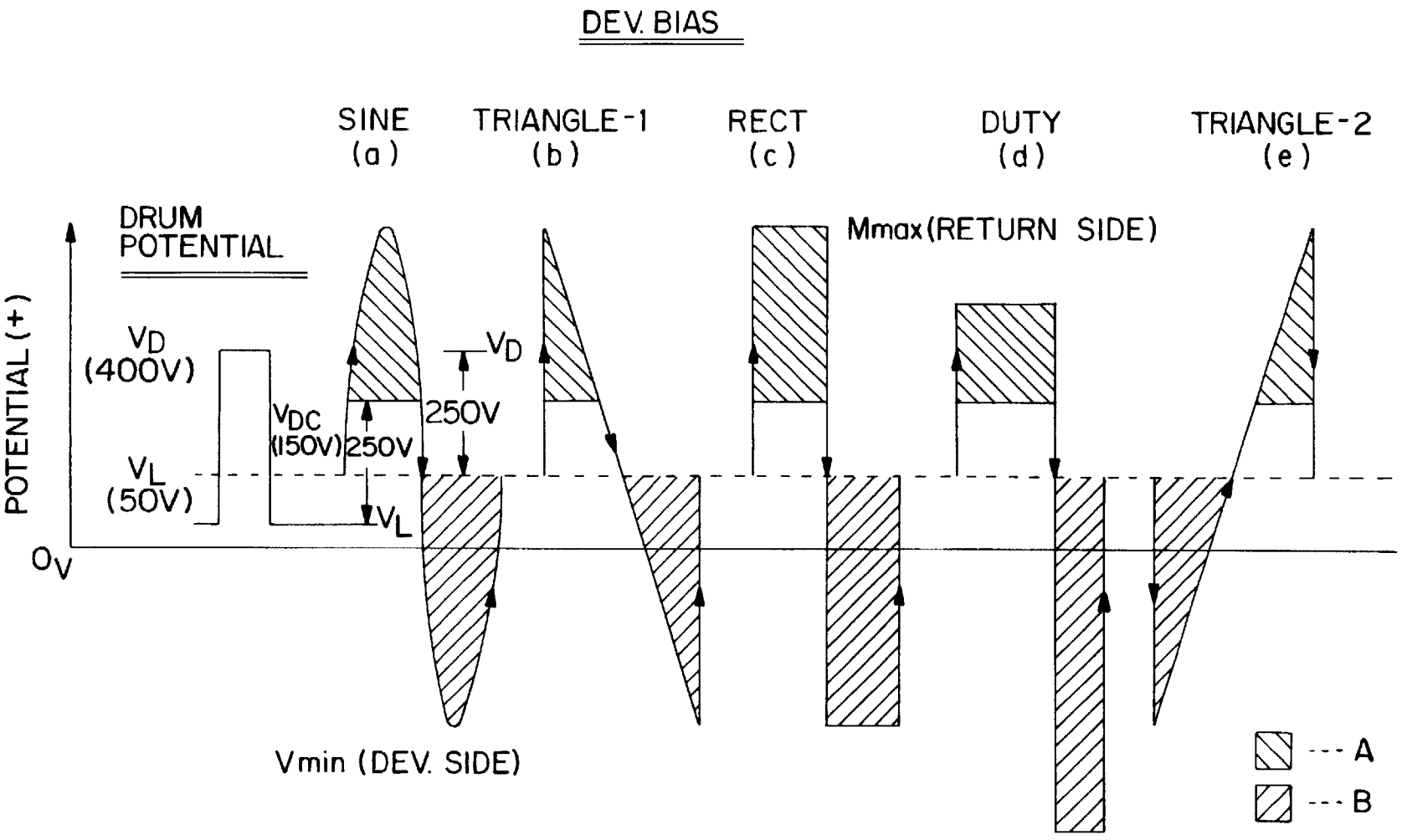
FIG. 5 illustrates a bias waveform in a conventional example.

Similar to FIG. 5, a potential relation with $V_D$ and $V_L$ is shown, but the abscissa represents time to illustrate a change in the AC bias.

In this embodiment, the developing device is the one shown in FIG. 6.

The change of the developing bias is shown in a time series. The developing bias falls from the "a" point toward the c point. Here, because of the falling of the transformer, some time is required for the change from the "a" point to the "c" point. When the potential is lowered beyond the "b" point where the potential difference from the $V_D$ is approximately 250, the toner on the sleeve overcomes the mirror force to start to jump to the drum.

In 25% of one period from the "c" point to the "d" point, the transferring potential Vmin is maintained to effect the development and the potential rises again from a d point.

At this time, the potential rises such that the change toward the back-transfer potential Vmax is slow. A high voltage transformer has a transient rising voltage conventionally, and it is approximately 10–20%. In this embodiment, it is important that the rising time is deliberately made larger, for example, it is larger than 50% of one period in this embodiment.

At an "e" point which is the half point of the period, it is crossed with an integrated DC value $V_{DC}$ of the AC component. Therefore, as described in conjunction with the conventional example, development is effected with the area of the region defined by dcde. A comparison among sin/triangular wave/rectangular/slope waves, yields $2:\frac{1}{2}\pi:\pi:\frac{3}{4}\pi=2:1.57:3.14:2.36$. Thus, using the slope bias, the intensity of the development is larger than when sine wave is used. This is determined by the percentage of the c–d length relative to the one period length. When it is larger than approximately 15%, the area can be made larger than that of the sine wave.

The developing bias further rises, and when the "f" point is reached, the potential difference is approximately 250V, and therefore, the reversely charged toner starts to jump at the $V_L$ portion. The bias reaches the "h" point of Vmax through g point. In the period between the h–i points, the potential is a back-transfer potential for the regular toner, and the surplus toner deposed tot $V_D$ portion is back-transferred to the sleeve. On the other hand, for the reversely charged toner, it is transferred onto the $V_L$ portion. The length of h–i period is the same as that of the length between c–d, and therefore, the AC bias waveform is symmetrical. The voltage again rising at the i point, and this is repeated.

The area of the region fhij for developing with the reversely charged toner (the region not less than 250V higher than the $V_L$ portion), is assuredly smaller than the corresponding area of the rectangular wave.

This effect increases with a decrease in steepness or sharpness of the slope, and on the contrary, the effect decreases with an increase in the steepness or sharpness. In this respect, the present invention is different from a rectangular wave having a steep or sharp change and in the conventional example wherein the time is approximately 10–20%.

Figure 2:
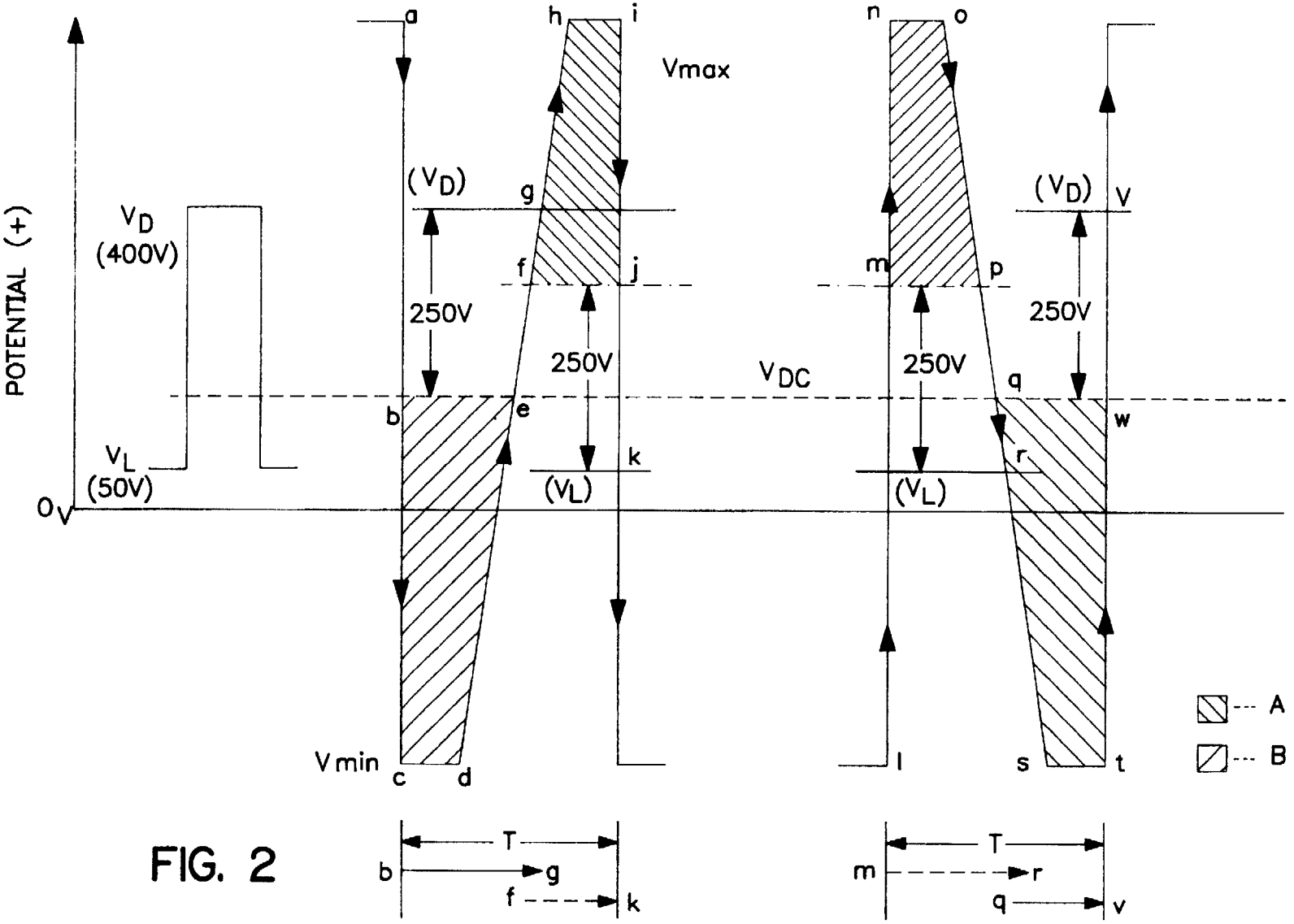
FIG. 2 illustrates the effect of bias voltage of the present invention.

Thus, the intensity of the development side is made stronger than that when a sine wave is used, and the tendency for producing the reverse charge fog is decreased as compared with the use of a rectangular wave. A waveform falling a less steeply as shown in FIG. 2, (b) also corresponds to such a bias waveform. FIG. 2, (a) shows the same waveform as FIG. 1.

A comparison between the waveform of FIG. 2, (a) and the waveform of FIG. 2, (b), to produce the effect shown in the following tables, has been confirmed by the inventors.

TABLE 1

| | sine wave | slope wave (a) | rect. wave |
|---|---|---|---|
| Density | No good | Good | Good |
| Rev. fog | Good | Good | No good |

TABLE 2

| | sine wave | slope wave (b) | rect. wave |
|---|---|---|---|
| Density | No good | Fair | Good |
| Rev. fog | Good | Fair | No good |

The Slope wave (b) exhibits a density and reverse charge fog property between those of the sine wave and the rectangular wave, respectively, but the density and the reverse charge fog property are not sufficient. However, the Slope wave (a) exhibits substantially the same density as in the rectangular wave, but the reverse charge fog is substantially the same as in the sine wave.

Referring to FIGS. 2, (c) and (d), the reasons for this will be described. In FIGS. 2 (c) and (d), T is a length of 1 period of the periodically changing developing bias, and b–g and q–v are the time periods in which the AC bias is to transfer the regular toner to the $V_D$ portion, and f–k and m–r are time periods in which the AC bias is to transfer the reversely charged toner to the $V_L$ portion.

Looking at FIG. 2, (c) together with FIG. 2, (a), the regular toner starts to transfer to the drum against the mirror force at the b point, and the force therefor substantially corresponds to the area, as described hereinbefore. Thereafter, hardly any force is applied in the e–f period. But, the developing bias is larger than $V_D$. Until it is shifted at the "g" point toward the back-transfer side, the toner continues moving toward the drum by inertia. The moving speed decreases due to the resistance of the air or due to the collision among the toner particles. Therefore, the time in which the toner is moving in the developing direction occurs only in the b–g period,. while the force received for the developing direction substantially corresponds to the area bcde.

Similarly, the time in which the reversely charged toner is moving to $V_L$, starts at f and continues in f–k period, wherein the developing bias is lower than $V_L$. With the slope bias (a) having an inclination at the back-transfer side of the AC bias, the development time for the regular toner can be made larger than 50% of the 1 period T, and the time period in which the reversely charged toner is transferred to the $V_L$ is made smaller than 50% thereof.

On the other hand, in FIG. 2, (d), the development period q–v can only be made approximately 50%, arid the time period for developing the reversely charged toner becomes longer than 50%. With the sine wave and rectangular wave, they are all approximately 50%. Therefore, with the waveform of FIG. 2, (b), simply, the force qstu for the development side is larger than that of the sine wave, and smaller than the rectangular wave, and therefore, the density is between those of the sine wave and rectangular wave, and the reverse charge fog property is also between them.

On the other hand, with the waveform of FIG. 2, (a), the force bcde is smaller than that of the rectangular wave, and therefore, the density is smaller, but density insufficiency is compensated for by the b- rectangular wave period (development time) being larger than 50%, so that the density is comparable to that produced when a rectangular wave is used.

For the reverse charge fog, the area fhij is larger than the sine wave, and therefore, the reverse charge fog occurs more easily, but this is compensated for by the f–k period (reverse charge fog time) being reduced to less than 50%, so that the reverse charge fog prevention effect is equivalent to that when a sine wave is used.

As described above, the rectangular wave is changed to be provided with a relatively large inclination toward the back-transfer side for the regular toner in the development AC bias, by which a waveform is produced which is capable of satisfying both the requirement for sufficient density and reverse toner fog prevention, which are not accomplished by a sine wave or a rectangular wave. This is carried out with a Vpp equivalent to the conventional ones, and therefore, there is no risk of leakage.

The difference from the duty bias shown in FIG. 5, (d), is that the B portion is smaller than a rectangular wave, and therefore, the density is smaller. However, the level of Vmin is lower, and therefore, the developing electric field $1V_{D-Vmin1}$ is higher than that of a rectangular wave, and therefore, the developing time is shorter. There is no problem with this if there is a high triboelectric charge development with which the toner reaches the drum in a short period of time, because the density is not lowered, but if the triboelectric charge is the same, density insufficiency occurs.

With the reverse charge fog, the A portion is smaller than the rectangular wave, so that reverse charge fog does not occur easily. But, correspondingly the developing time is longer for the reversely charged toner, and this advantage is offset, with the result of poor reverse charge fog prevention.

The difference from the waveform having a less sharp portion as shown in FIG. 5, (e), is that in order to increase the area of the B portion, only the increase of the Vpp is used in FIG. 5, (e); but in this embodiment, the Vmin is continued in the period from the "c" point to the "d" point in FIG. 1, which is as long as at least 15% of the 1 period, and therefore, with the same Vpp, this area is made larger up to ⅔ times or larger than the triangular wave, so that the density is improved.

A detailed description of experiments will be described.

The developing device is as shown in FIG. 6.

In the experiments, the average triboelectric charge of the toner is −10 μC/g approx. The triboelectric charge amount of the toner changes depending upon prescription of the toner, the particle size thereof, the addition of electrification control material, the surface property of the developing sleeve 2, the distance between the regulating member 4 and the developing sleeve 2, and the degree of packing of the toner (density of the toner) or the like. In this embodiment, the use is made of a magnetic toner of the stylene acrylic type having an average particle size of 8 μm, and silica is added to the toner powder to provide it with proper flowabilty.

The developing sleeve 2 was made of non- magnetic stainless steel which has a surface having been subjected to a blast process with #400 glass beads. The regulating member 4 was made of magnetic stainless steel having a thickness of 1.2mm. The gap between the regulating member 4 and the developing sleeve 2 was 200 μm. Under the above conditions, the triboelectric charge amount of the toner was −10 μC/g, and the application amount was approximately 0.8–1.2 mg/cm$^2$.

The magnet roller 3 was magnetized to have 4 poles, and the developing pole in the developing zone faced the photosensitive drum 1, and was effective to erect magnetic toner particle chains on the developing sleeve 2 by the magnetic force of approximately 800–1200 Gauss. Under these conditions, jumping development is carried out by the alternate electric field described above. The gap between the developing sleeve 2 and photosensitive drum 1 at the closest position was 200 μm, and the developing sleeve 2 was rotated in the same peripheral direction as the photosensitive drum 1 at a peripheral speed substantially at approximately 1.5 times that of the photosensitive drum 1.

The developing bias was the one shown in FIG. 1, and Vpp=1000, frequency=2.2 kHz. The integrated DC value was approximately 150V.

Figure 3:
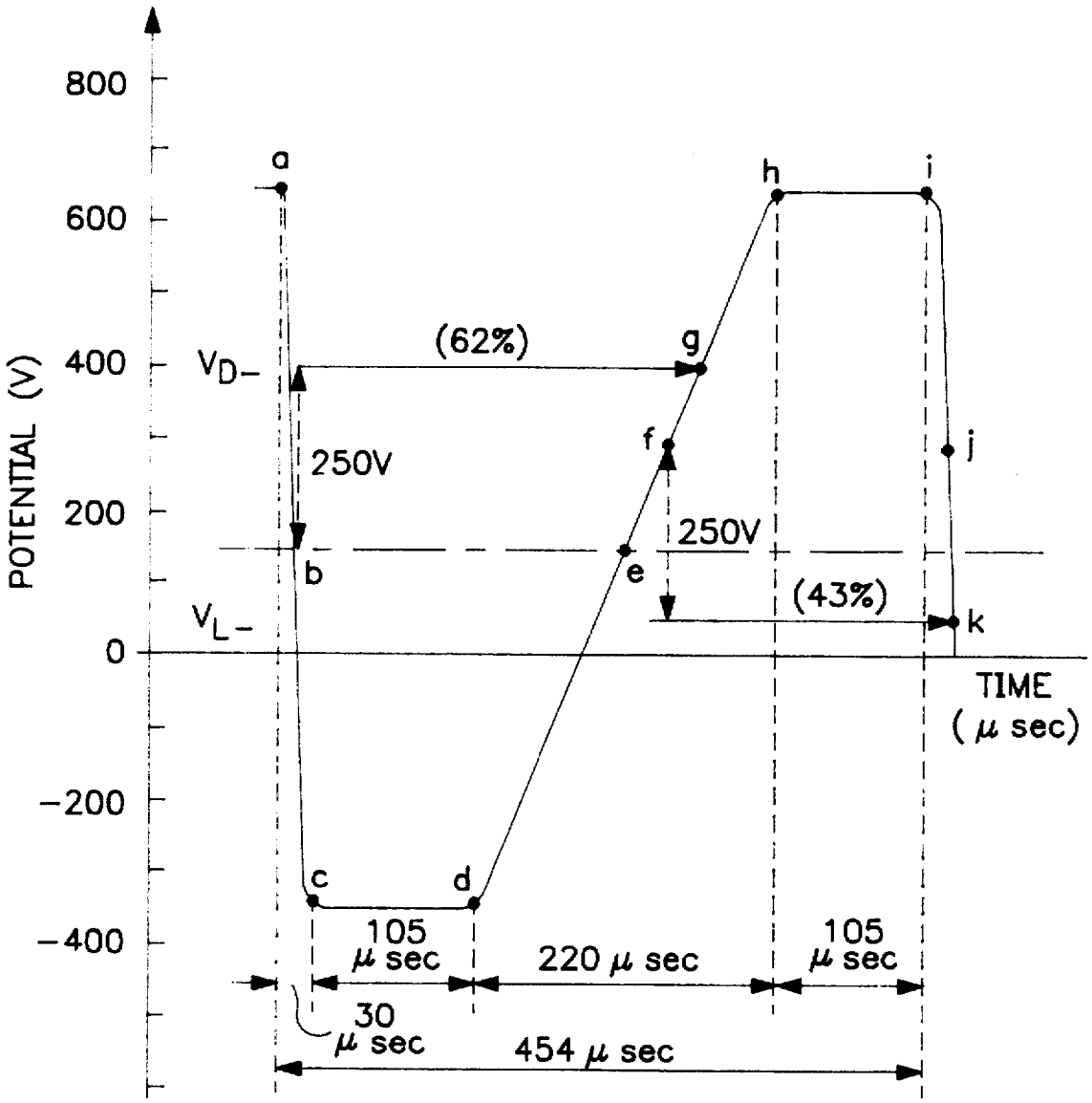
FIG. 3 shows an actual waveform of the bias voltage used in the first embodiment.

In the actual waveform, the time required for a change from the "a" point to "c" the point was approximately 30 μsec, and the actual waveform was as shown in FIG. 3. Therefore, the length of the b–g period is approximately 62% of the 1 period, and f–k length is 43%.

The image forming operations were carried out under these conditions, and the image density was 1.35 which was higher than that when the sine wave was used by approximately 0.10, and which is substantially the same as that when the rectangular wave is used. The reverse charge fog prevention was better than the rectangular wave is used, and was equivalent to that of the sine wave.

The density was measured by a Machbeth RD914 available from Machbeth Corp., and the reverse charge fog was measured by TC-6DS available from TOKYO DENSHOKU KABUSHIKI KAISHA, Japan using the reflectance of white paper as a reference. After measuring the reflectance of the white paper, the reflectance of the non-image portion of the copy was measured, and the differences in the measurements were taken as the degree of the fog. The length of the slope is changed to 80%, 70%, 50%, 30% and 20% of the 1 period, and the density and the fog were compared with those generated when the sine wave and the rectangular wave were used. The results are shown in Table 3. The voltage Vpp was maintained constant.

TABLE 3

| | | <—— | | slope | | ——> | |
|---|---|---|---|---|---|---|---|
| | sine | 80 | 70 | 50 | 30 | 20 | rect. |
| Density | 1.15 | 1.15 | 1.25 | 1.35 | 1.35 | 1.35 | 1.35 |
| Rev. fog | 1.0% | 1.0% | 1.0% | 1.0% | 1.5% | 2.5% | 3.0% |

The rectangular wave used rose steeply, namely, 10% of 1 period. It will be understood that in order to assure a density of 1.20 and a fog of 2.0% or lower, the slope is 30–70%.

With the bias described above, it has been found that the uniformity of the half-tone image is better, as a general tendency. The reason for this is not very clear, but would likely be because the change to the transfer-back side is less steep, thereby causing the toner deposited on the drum to be transferred back slowly so that the toner image is not disturbed.

In another experiment, a latent image was formed under a condition similar to that of FIG. 1, and the used developing device had a structure as shown in FIG. 7 with non-magnetic toner (one component non-magnetic developer) used as the toner. This will now be described.

A developing device 5' of FIG. 6 accommodates non-magnetic toner, and the toner is stirred by stirring blades 7 and is supplied to the application roller 6 which supplies the toner to the developing sleeve 2'. The toner is electrically charged by friction with the elastic blade 4' or the developing sleeve 2' rotating in the direction indicated by the arrow, the charged toner is attracted on the developing sleeve 2' by the mirror force, and is passed under the elastic blade 4' to be carried into the developing zone.

The developing sleeve 2' remaining on the sleeve, is returned to the developing device 5' by the rotation of the developing sleeve 2', and it is scraped off the sleeve by the contact with the application roller 6. The charge polarity of the toner is negative similar to the first embodiment.

The elastic blade 4' was made of silicone rubber which was press-contacted counterdirectionally to the developing sleeve 2' at the line pressure of 15–20 g/cm. The used toner was a non-magnetic toner of the stylene acrylic type colored with carbon black and having an average particle size of 8 μm. To provide it with the proper flowability, silica was added to the powdery toner.

At this time the triboelectric charge amount of the toner was approximately −15 μC/g, and the application amount was approximately 0.1–0.8 mg/cm$^2$. The toner charging amount is higher than −10 μC/g of the magnetic toner in the first embodiment. The reason is as follows. In the case of magnetic toner, the toner can be attracted on the developing sleeve also with the magnetic force, but in the case of non-magnetic toner, the toner is deposited on the developing sleeve only by the mirror force. Therefore, by increasing the charging amount, the mirror force is increased, since otherwise, the toner can be easily transferred to the photosensitive drum with the result that fog occurs.

The developing device described above was disposed relative to a photosensitive drum with a gap of approximately 180 μm therebetween. The developing sleeve 2' was rotated at a peripheral speed of approximately 1.5 times that of the photosensitive drum 1 and in the same peripheral movement direction.

The used developing bias was as shown in FIG. 3.

As compared with the foregoing experiment example, the triboelectric charge is higher, and therefore, the mirror force to the sleeve is larger so that the toner particles less easily depart from the developing sleeve. In view of this, the S–D distance is decreased to raise the substantial field intensity. Simultaneously, the back-transfer intensity is slightly increased, so that the fog is suppressed even if the non-magnetic toner is used. For the purpose of fog prevention, the frequency of the bias voltage and the $V_{DC}$ thereof may be adjusted.

Under these conditions, image formations were carried out, and the image density was higher than that when a sine wave is used by approximately 0.15, and was 1.40, which was equivalent to the that produced when a rectangular wave is used. The reverse charge fog prevention was improved over such prevention when a rectangular wave is used, and was equivalent to that which occurs when a sine wave is used.

In the foregoing, a description has been provided as to a one component development apparatus, but the embodiments are applicable to a well-known two component application using an alternate bias. In this case, the coating of the developer on the developing sleeve is thicker, and therefore, the S–D gap is preferably increased to 500–1000 μm, and correspondingly, the peak-to-peak voltage is increased, as will be readily understood. However, when two component development is used, the reverse charge tog prevention effect is also a carrier deposition prevention effect. In the foregoing the polarity of the toner was negative to effect the regular development, but reverse development is usable.

Also, these concepts can be applied to development with a positive toner. In this case, the bias waveform of FIG. 3–FIG. 4 is inverted in the vertical direction in the figures.

As to the photosensitive drum, a description has been provided as to an a-Si drum, but the well-known OPC drum can be used. In this case, the kO charge potential can be relatively higher than in the a-Si drum, and therefore, the difference between the $V_D$ and $V_L$ is higher than in this embodiment. Therefore, the latitude for the bias waveform is wider.

Second embodiment

Figure 4:
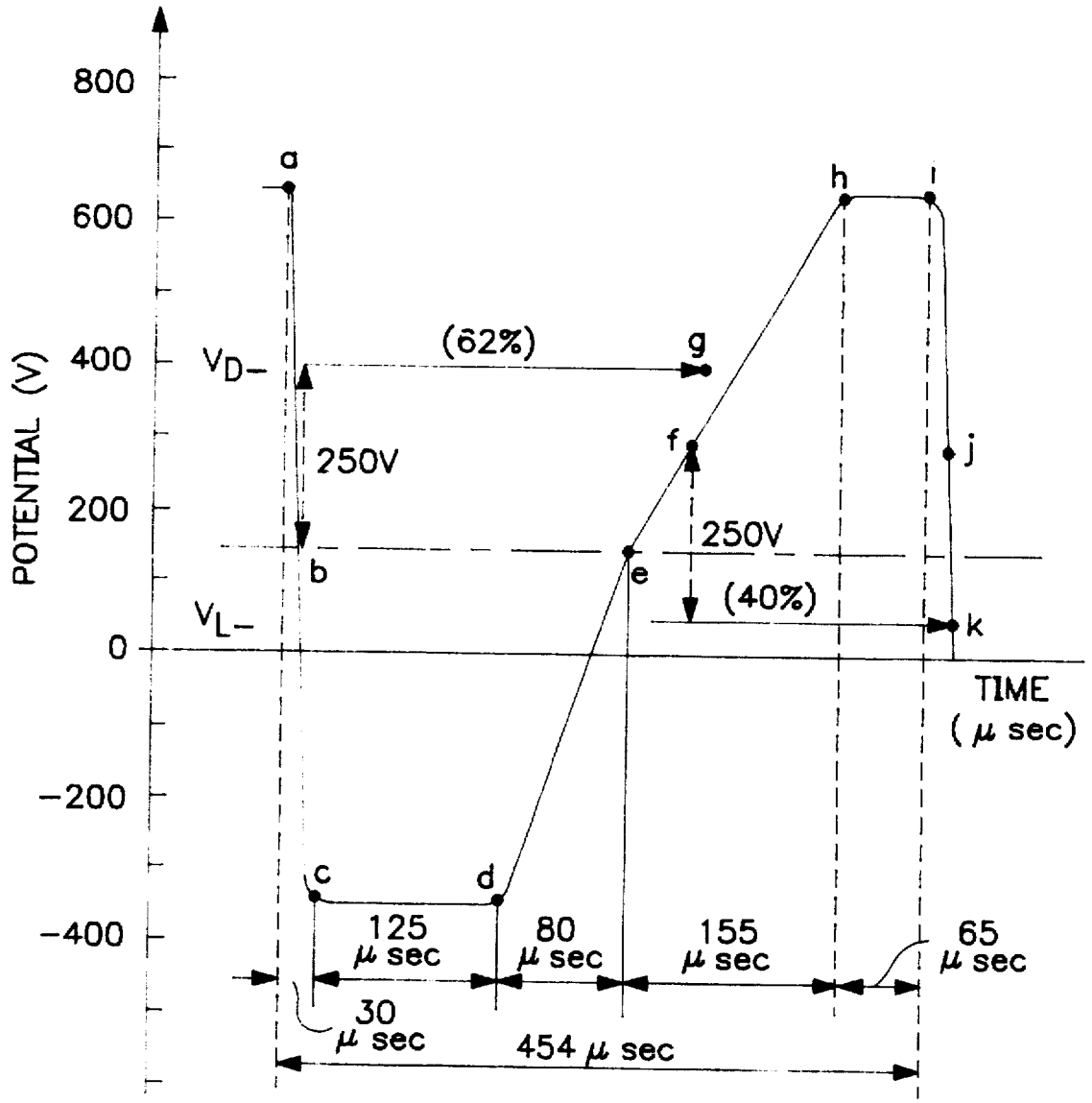
FIG. 4 shows an actual waveform of the bias voltage used in a second embodiment of the present invention.

In this embodiment, the used developing bias was as shown in FIG. 4 with various development types used in the first embodiment. The Vpp was 1000V and had a frequency of 2.2 kHz, and $V_{DL}$ was 150V This embodiment is different from the first embodiment in that the rising profile is changed during the rising. Therefore, the circuit structure of the transformer is slight complicated.

However, since the $t_D$ is 65% of one period, and $t_L$ is 40% thereof, the density and reverse charge fog prevention are greater than the first embodiment. Since the back-transfer side Vmax is 65 μsec which is short, fog tends to occur, and therefore, some parameter, for example, the gap between the developing device and the drum, is made larger than in the first embodiment. By doing so, fog is reduced to the level of that in the first embodiment.

Third embodiment

Figure 10:
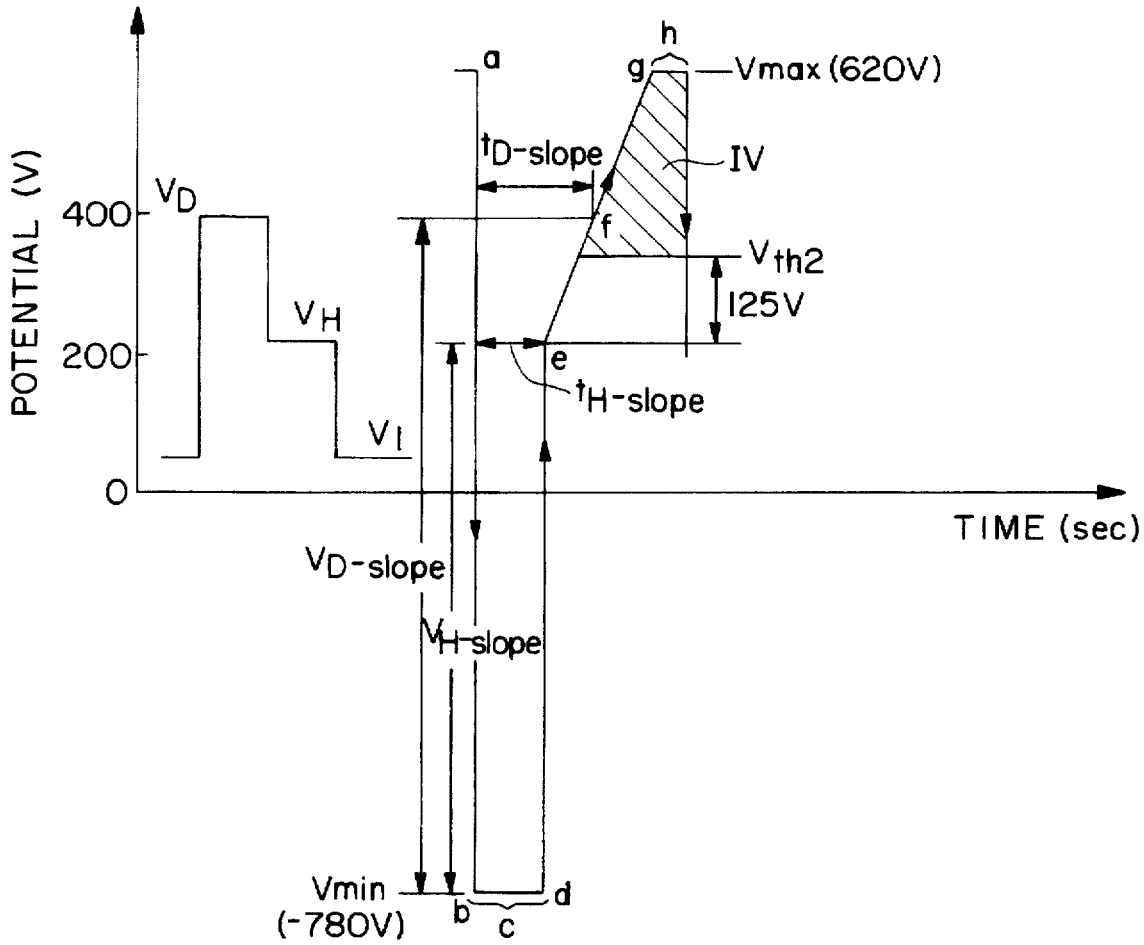
FIG. 10 shows a developing bias used in a third embodiment of the present invention.

Referring to FIGS. 10 to 13, the third embodiment of the present invention will be described. FIG. 10 shows a developing bias waveform of this embodiment, which is effective to produce sufficient image density and uniformity of the half-tone image even when a low triboelectric charged toner is used for development. This waveform will also be called a slope bias voltage.

Similar to FIG. 1, the potential relation among $V_D$, $V_H$ and $V_L$ is shown, but the abscissa represents the time to show the change of the developing bias of the AC. The bias voltage will be described in a time series.

In this embodiment, the developing device has the same structure as in the foregoing embodiment. The toner triboelectric charge on the sleeve is −10 μC/g. However, for the purpose of explanation of the low triboelectric charge, the developing device has been operated continuously to cause the developer to deteriorate to have a triboelectric charge of approximately −8 μC/g and then, the developing device has been kept unused. Then, the use of the device is started. Under this situation, the triboelectric charge is as low as approximately 6 μC/g.

The developing bias falls from the "a" point to the "b" point. In order to deposit the toner to the $V_D$ portion or the $V_H$ portion, the potential difference $V_{D\text{-}slope}$ or $V_{H\text{-}slope}$ is to be large enough to overcome the mirror force of the toner on the sleeve to cause the toner to jump from the sleeve Then, the developing bias continues the minimum value Vmin of the AC component from the "b" point during the c period, wherein the length of the period c is 35% of the one period.

The same considerations as in duty bias apply to the developing bias up to the rising at the d point.

However, at the "e" point where the bias rises up to $V_H$, the developing bias rising is controlled to be made slower. In this embodiment, the bias voltage having such a slow rising is called a slope bias.

The developing bias rises slowly after the "e" point, and at f point, it reaches the $V_D$ level. The time period up to here is not less than 50% of one period. In this embodiment, the $t_{D\text{-}slope}$ is 55% in FIG. 1. The maximum value Vmax is taken at g point, and it continues during the period h, and then falls similarly to a point. As to the transformer for producing such a developing bias, it is not described in detail for the purpose of simplicity of description. Briefly, clock signals are produced, and the increases of the voltages in the periods between clock signals are controlled. By the use of such a bias voltage, the inventors have found that even if the development is carried out using a low triboelectric charge toner, the image density and the uniformity of the half-tone image are improved. The reason for this will be described.

Figure 11:
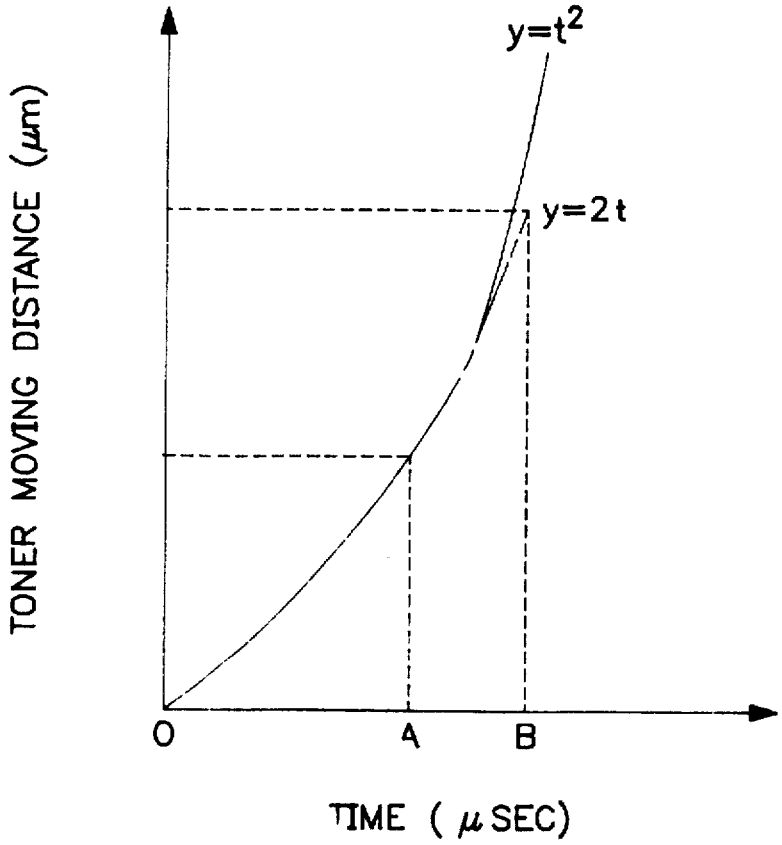
FIG. 11 illustrates the application period of the developing bias vs. The transfer distance of the toner.
Figure 12:
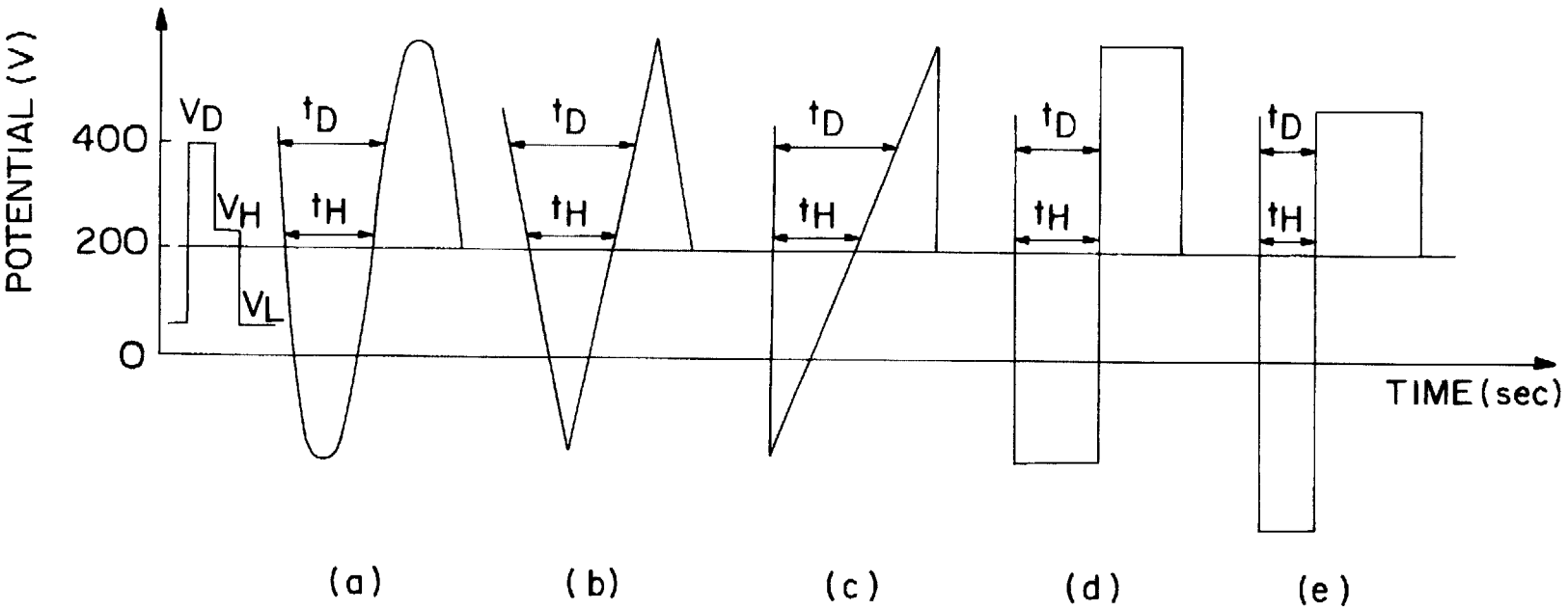
FIG. 12 illustrates the difference between the conventional example and the present invention.

As regards image density, the development of the $V_D$ portion will be discussed. When a comparison is made with FIG. 9, it will be understood that the time $t_{D\text{-}slope}$ for developing the $V_D$ portion is longer than in the duty bias. So, it is considered that low triboelectric charged toner particles, which receive from the developing electric field a weak force, namely, and whose jump distance in a predetermined time is short, can reach to the drum, thus improving the density. Referring to FIG. 11, the jumping distance or height of the toner in a constant electric field, is expressed as a secondary function of the time as shown. That is, it is expressed as a solid line in the figure which is a graph of time vs. distance. Even if the electric field stops at the A point, the toner continues to move at the same speed as long as no opposite bias is applied (actually, however, the speed is slightly lower due to air resistance), and the jumping height extend as indicated by the one point wave line in the figure.

For example, the time up to the A point is assumed as $t_{D\text{-}duty}$. The period $t_{D\text{-}duty}$ is 35% of one period, and $t_{D\text{-}slope}$ is 55% of one period, and therefore, $t_{D\text{-}slope}$ is longer than $t_{D\text{-}duty}$ by approximately 1.5 times. The 1.5 times long point from the A point is indicated as the B point, and the jump distance of the toner at this time is approximately twice the jump distance to the A point.

Actually, however, there is air resistance and collision of toner particles, and there is an electric field in the transfer direction for the $V_D$ although the intensity is small from the "e" point to the "f" point. Therefore, the above calculation is not very accurate. However, it is estimated that the amount of the toner reaching the $V_D$ portion of the drum increases, thus improving the image density of the $V_D$ portion.

The inventors have found that when the $t_{D\text{-}slope}$ is larger than 50% of one period, the improvement of the image density is remarkable.

In low triboelectric charged toner development, whether toner having a low triboelelectric charge and therefore, low responsivity to an electric field reaches the drum depends significantly on the length of the development time. If the development time is not more than one and one half the one period, the back-transfer time exceeds one half so that the toner is easily transferred back with the result of insufficient density.

It is considered that for the reasons described above, the bias voltage of this embodiment having $t_{D\text{-}slope}$ in the period not less than 50%, caused the improvement in the density.

A description will be provided as to the improvement in the uniformity of the half-tone portion. As to the toner particles to be deposited on the half-tone portion $V_H$, it is the same as with the duty bias in FIG. 9 up to the e point, and therefore, substantially the same amount of the triboelectric charge toner reach the $V_h$ portion, and are deposited on the drum. Such toner particles are considered as having a relatively high triboelectric charge toner among the toner particles having an average triboelectric charge of −6 μC/g, but it is considered that the average triboelectric charge thereof is still lower than −10 μC/g.

After the toner having slight low triboelectric charge is deposited on the $V_H$ portion, the developing bias changes to the back-transfer side. It is assumed, as in the explanation of the conventional example, that the back transfer of the toner deposited to the $V_H$ portion starts when the potential difference from $V_H$ becomes 125V.

Figure 9:
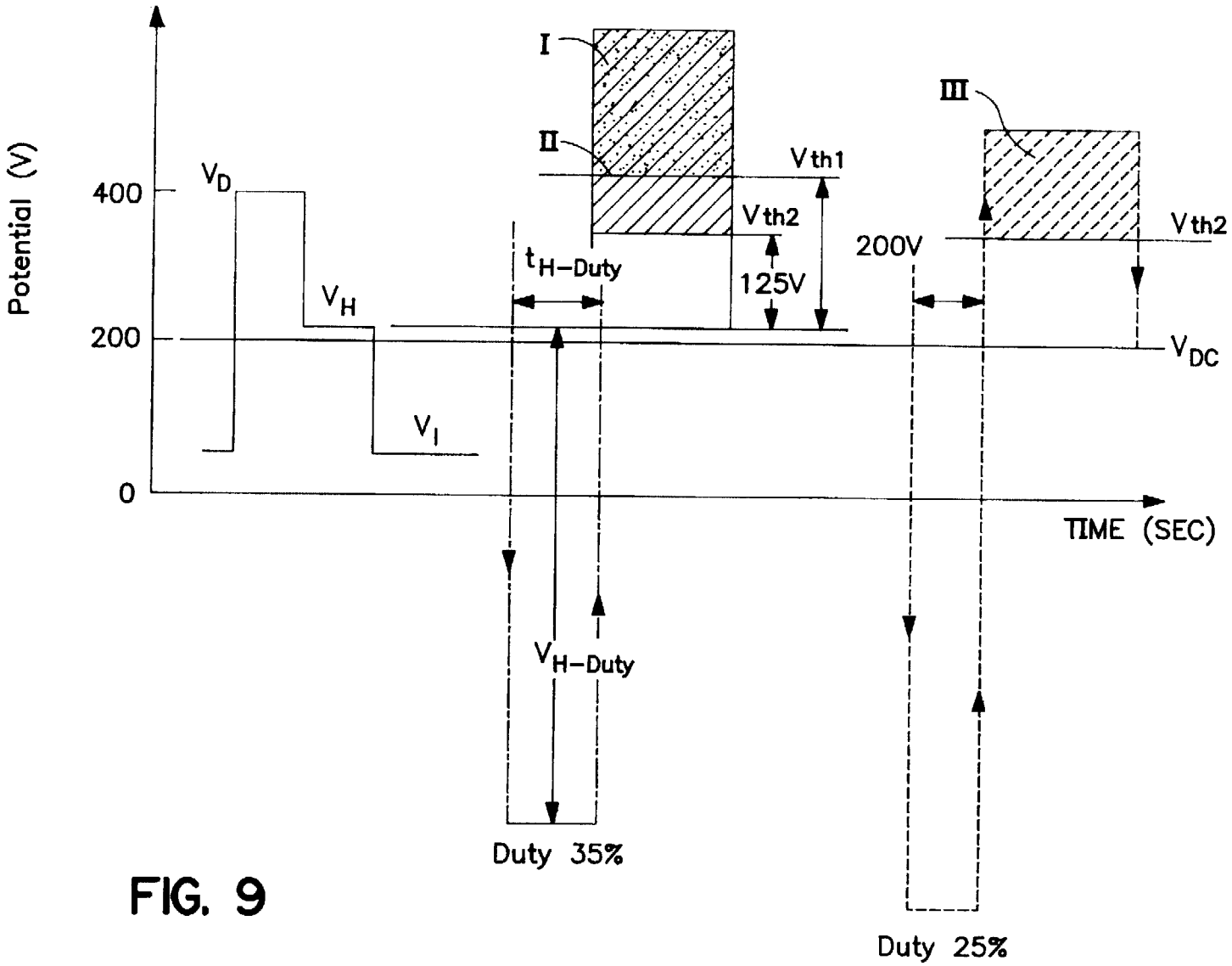
FIG. 9 shows another developing bias in a conventional example.

The strength of the back-transfer at this time corresponds to the area of the region II indicated by the hatched lines in FIG. 9 if a duty bias is used. It is considered that with the slope bias, the toner is transferred back with a strength corresponding to the area of the region IV indicated by the hatched lines in the FIG. 1. Since it is apparent that the region IV indicated by the hatched lines in FIG. 10 is smaller than the region II indicated by hatched lines in FIG. 9, the use of the slope bias can weaken the back-transfer of the toner, thus improving the uniformity of the half-tone portion.

The duty bias has such a property, from the beginning, that the toner particles having a triboelectric charge higher than the average triboelectric charge can be deposited to the $V_H$ portion. When, the average triboelectric charge is low, the triboelectric charge of the toner capable of depositing to the $V_H$ portion has to be low. Even under such a situation, the use of the slope bias is advantageous, since then the toner having a slightly higher triboelectric charge than the average triboelectric charge can be deposited to the $V_H$ portion, and the provision of the slope in the developing bias is effective to weaken the back-transfer for the toner having the not sufficiently high triboelectric charge, by which the uniformity of the half-tone image portion can be improved.

The half-tone portion in this present invention means the portion in which the image density is not more than 0.8.

When the uniformity of the half-tone is considered, the higher density part is not a problem even if the uniformity is slightly low, but the slight non-uniformity causes a conspicuous deterioration of the image quality in the low density area.

In order to uniformly reproduce a high light portion having a density of 0.2–0.4, the potential for reproduction of the density of such a level, is taken as VH in designing the developing bias voltage.

Depending on the development type, $V_H$ may be lower than $V_{DC}$, but fundamentally, $V_H$ is higher than $V_{DC}$. Such actual setting levels are determined properly by one skilled in the art, after the $V_H$ is determined for the image forming apparatus to be designed.

As described above, the time $t_{H\text{-}slope}$ for developing the half-tone $V_H$ is less than 50% of one period, and the time $t_{D\text{-}slope}$ for developing the $V_D$ is not less than 50% of one period by the use of the slope bias, wherein a small inclination is provided in the rising period toward the back-transfer side for the toner in the developing bias, and the inclination is controlled. By doing so, a sufficient image density and a sufficient uniformity of the half-tone image can both be achieved even if a low triboelectric charged toner is used for the development.

The development time for a low density portion of the half-tone $V_H$ portion is the time in which an original image having a density of 0.2 as measured by Machbeth RD919, available from Machbeth Corp., is reproduced with a standard density of the device.

The difference from the conventional developing bias is such that in the sine wave, triangular wave, saw-teeth wave, and rectangular wave, as shown in FIG. 2, (a), (b), (c), (d), the time for developing the half-tone $V_H$ portion and the time for developing the $t_H$ and the $V_D$ are not less than 50% of one period. On the other hand, in the duty wave, as shown in FIG. 2, (e), $t_H$ and $t_D$ are both less than 50%, and therefore, they are all different from the present invention. This relation does not significantly change even when the bias voltage changing portions are slight dull.

A detailed description of experiments will be described. The used developing device is as shown in FIG. 6.

The average triboelectric charge of the toner was approximately −6 μC/g approximately in the experiments. The triboelectric charging property of the toner is dependent on the toner, the particle size thereof, the addition of the electrification control material, the distance of the developing sleeve 2, the size of the gap between the regulating member 4 and the developing sleeve 2, and the strength of the packing of the toner (toner density) or the like. In this embodiment, use was made of magnetic toner of the stylene acrylic type having an average particle size of 8 μm, and to provide proper flowability, silica was added to the powder of the toner.

The developing sleeve 2 was made of non- magnetic stainless steel having a surface which have been subjected to a blast process with #400 glass beads. The regulating member 4 was made of magnetic stainless steel having a thickness of 1.2 mm. The gap between the regulating member 4 and the developing sleeve 2 was 200 μm. With the above conditions, the triboelectric charge amount of the toner was −10 μC/g, and the application amount was approximately 0.8–1.2 mg/cm$^2$ at the initial stage.

The triboelectric charge of the developing device after the continuous image forming apportions was approximately −8 μC/g approximately, and was approximately −6 μC/g approximately after it was left unused.

The magnet roller 3 was magnetized to have 4 poles, and the developing pole in the developing is zone faced the photosensitive drum 1, and was effective to erect magnetic toner particle chains on the developing sleeve 2 due to the magnetic force of approximately 800–1200 Gauss. Under these conditions, jumping development is carried out by the alternate electric field described above. The gap between the developing sleeve 2 and photosensitive drum 1 at the closest position was 200 pm, and the developing sleeve 2 was rotated in the same peripheral direction as the photosensitive drum 1 at a peripheral speed substantially at approximately 1.5 times that of the photosensitive drum 1.

The developing bias was the one shown in FIG. 10, and Vpp=1400, frequency=2.2 kHz. The integrated DC value was not 200V, but approximately 100–150V.

Figure 13:
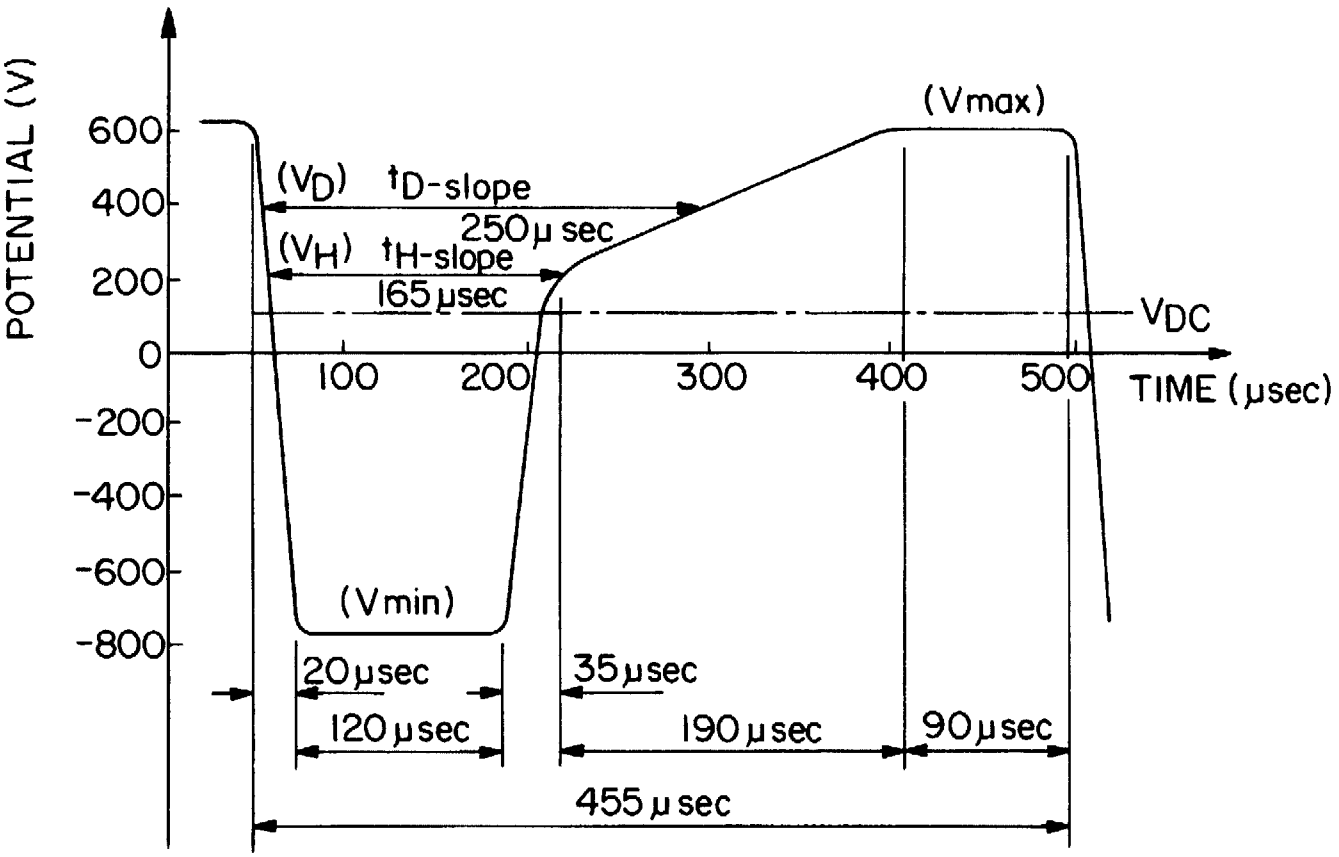
FIG. 13 shows an actual waveform of the developing bias used in the third embodiment of the present invention.

In the actual waveform, the time periods required for change from the "a" point to the "b" point and from the "d" point to the "e" point were approximately 20–40 μsec, and the actual waveform was as shown in FIG. 13.

The image forming operations were carried out under these conditions, and the image density was 1.25 which was higher than that with the duty bias by approximately 0.10. The uniformity of the half-tone portion was better than in the duty bias.

In another experiment, a latent image was formed under conditions similar to that of FIG. 10, and the used developing device had a structure as shown in FIG. 7 with non-magnetic toner (one component non-magnetic developer) used as the toner. This will now be described.

A developing device 5' of FIG. 6 accommodates non-magnetic toner, and the toner is stirred by stirring blades 7 and is supplied to the application roller 6 which supplies the toner to the developing sleeve 2'. The toner is electrically charged by friction with the elastic blade 4' or the developing sleeve 2' rotating in the direction indicated by the arrow, the charged toner is attracted on the developing sleeve 2' by the mirror force and is passed under the elastic blade 4' to be carried into the developing zone.

The developing sleeve 2' remaining on the sleeve, returns to the developing device 5' by the rotation of the developing sleeve 2', and it is scraped off the sleeve by the contact with the application roller 6. The charge polarity of the toner is negative.

The elastic blade 4' was made of silicone rubber which was press-contacted counterdirectionally to the developing sleeve 2' at a line pressure 15–20 g/cm.

The used toner was a non-magnetic toner of the stylene acrylic type colored with carbon black and having an average particle size of 8 μm. To provide it with the proper flowability, silica was added to the powdery toner.

At this time the triboelectric charge amount of the toner was approximately −15 μC/g. and the application amount was approximately 0.1–0.8 mg/cm$^2$ at the initial stage. The toner charging amount is higher than −10 μC/g of the magnetic toner in the first embodiment. The reason is as follows. In the case of magnetic toner, the toner can be attracted on the developing sleeve also with the magnetic force, but in the case of non-magnetic toner, the toner is deposited on the developing sleeve only by the mirror force. Therefore, by increasing the charging amount, the mirror force is increased, since otherwise, the toner can be easily transferred to the photosensitive drum with the result that fog occurs.

The triboelectric charge when the device is left unused after a continuous image forming operation under high humidity was approximately −10 μC/g or slightly lower.

The developing device described above was disposed relative to the photosensitive drum with a gap of approximately 180 μm therebetween. The developing sleeve 2' was rotated at a peripheral speed of approximately 1.5 times that of the photosensitive drum 1 and in the same peripheral movement direction. The used developing bias was as shown in FIG. 3.

As compared with the foregoing experiment example, the triboelectric charge is higher, and therefore, the mirror force to the sleeve is larger so that the toner particles are less easily depart from the developing sleeve. In view of this, the S-D distance is decreased to raise the substantial field intensity. Simultaneously, the back-transfer intensity is slight increased, so that fog is suppressed even if the non-magnetic toner is used. For the purpose of fog prevention, the frequency of the bias voltage and the $V_{DC}$ thereof may be adjusted.

Under these conditions, image formations were carried out, and the image density was higher than that when a the sine wave was used by approximately 0.05, and was 1.30 which was equivalent to that which occurs when a rectangular wave is used. The reverse charge fog prevention was improved. However, since the triboelectric charge is higher than in the foregoing experiment example than from the beginning, the effects are not as significant as in the foregoing experiment examples.

In the foregoing, a description has been provided as to a one component development as the development type, but the embodiments are applicable to a well-known two component application using an alternate bias.

In this case, the coating of the developer on the developing sleeve is thicker, and therefore, the S-D gap is preferably increased to 500–1000 μm, and correspondingly, the peak-to-peak voltage is increased, as will be readily understood.

In two component development, the effect under the use of the low triboelectric charge toner was the same as in the other experiment example.

Fourth embodiment

Figure 14:
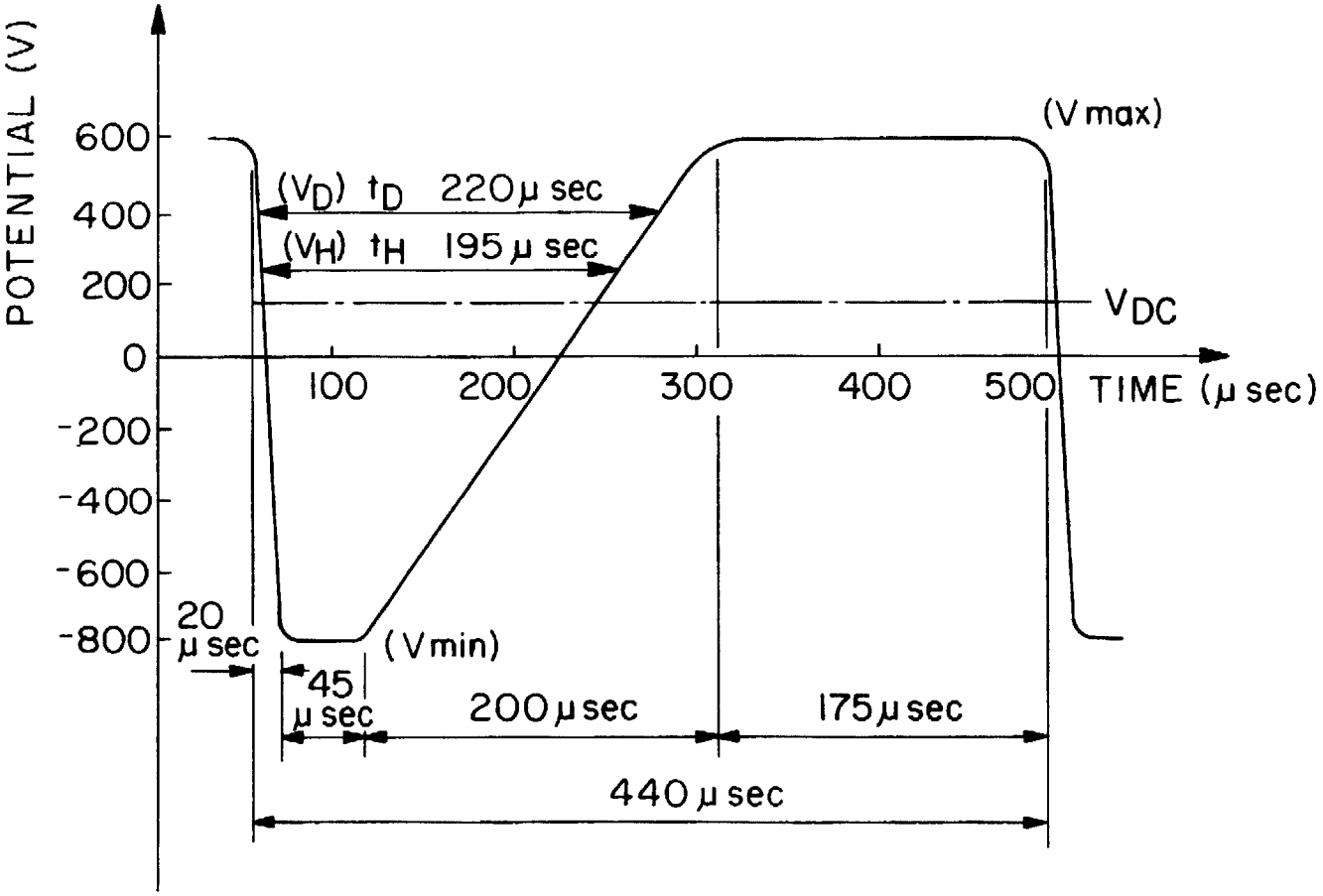
FIG. 14 shows an actual waveform of the developing bias used in a fourth embodiment of the present invention.

Referring to FIG. 14, a fourth embodiment will be described. The same reference numerals as in the third embodiment are assigned to the elements having corresponding functions, and detailed descriptions thereof are omitted for simplicity.

The development type used in this embodiment may be any one of various development types in the first embodiment and the developing bias was the one shown in FIG. 14, namely, Vpp is 1400V, and frequency is 2.3 KHz, and $V_{DC}$ is 150V.

This embodiment is different from the third embodiment in that the rising is substantially constant, and therefore, the circuit structure of the transformer is simpler.

However, since $t_D$ is 50% of one period, and $t_H$ is 45% thereof, the different therebetween is small. For this reason, the effect relating to the density and the half-tone uniformity is slightly smaller than that in the third embodiment. The time of the development promoting side Vmin is as short as 45 μsec, and the density tends to be low. Therefore, it is desirable to take a measurement against this, by, for example, decreasing the gap between the developing device and drum as compared with the third embodiment.

If this is done, it has been confirmed that the effects are substantially the same as in the third embodiment Fifth embodiment Referring to FIG. 15, a fifth embodiment of the present invention will be described. The same reference numerals as in the third embodiment are assigned to the elements having the corresponding functions, and detailed descriptions thereof are omitted for simplicity.

Figure 15:
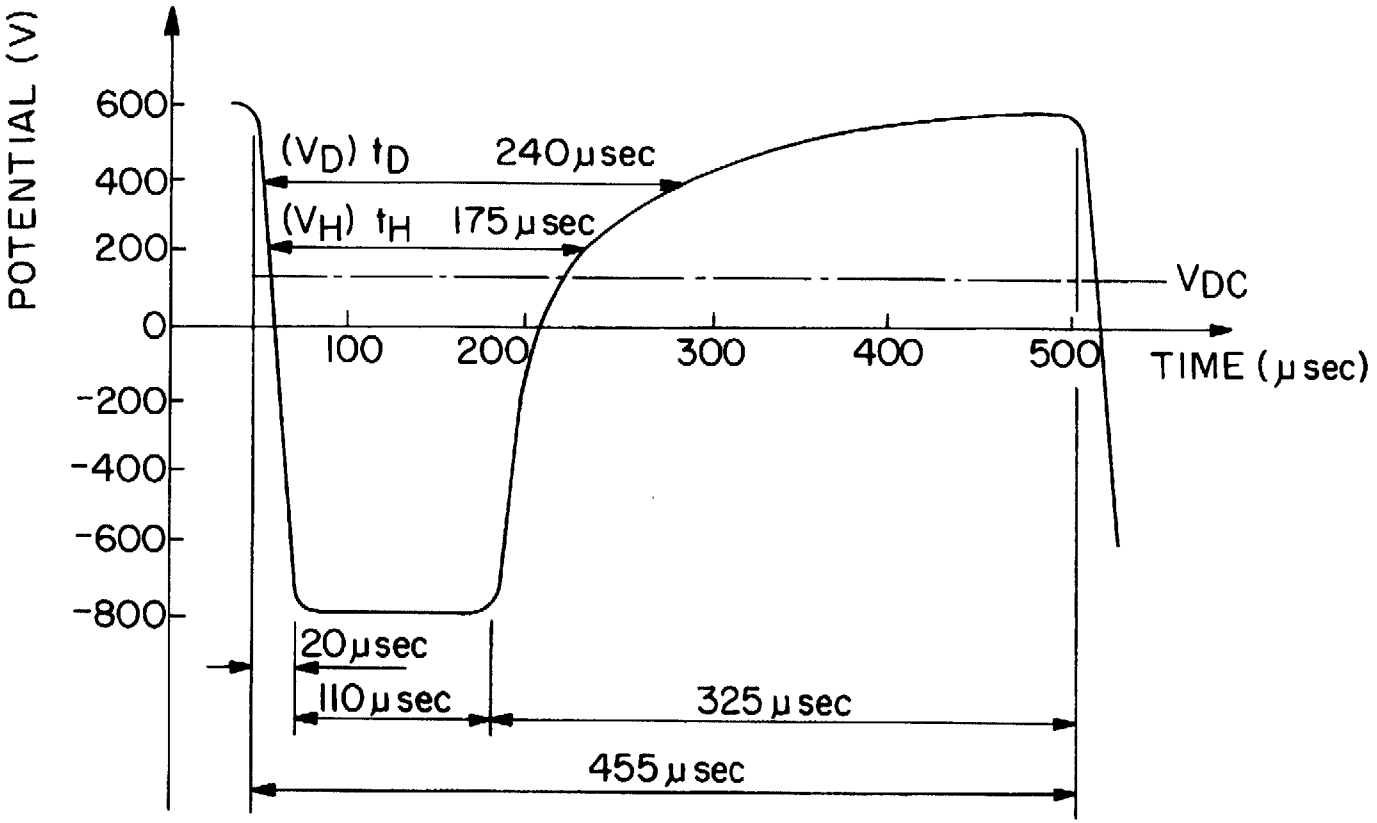
FIG. 15 shows an actual waveform of the developing bias used in a fifth embodiment of the present invention.

The used developing bias was the one shown in FIG. 15, namely, it had Vpp of 1400V, a frequency of 2.2 KHz, and $V_{DC}$ of 150V.

The rising of the bias was in an exp. function fashion, and therefore, the circuit structure for the transformer can be constituted by a CR circuit. Therefore, the structure is easier as compared with the foregoing embodiment.

The $t_D$ is 53% of 1 period, and $t_H$ is 38% thereof, and therefore, the same effects as in the first embodiment are provided.

Actually, the bias of FIG. 15 was used in place of the bias of FIG. 13 in the third embodiment, and it has been confirmed that substantially the same effects were provided.

A description has been provided as to the case in which the polarity of the toner is negative, but reverse development can be used also.

The embodiment is applicable to positive toner development, and in this case, the bias waveform of FIG. 13 or 14 is inverted vertically.

As to the photosensitive drum, a description has been provided as to an a-Si drum, but the well-known OPC drum is usable. In this case, the kO charge potential can be relatively higher than in the a-Si drum, and therefore, the difference between the $V_D$ and $V_L$ is higher than in this embodiment.

Therefore, the latitude for the bias waveform is wider.

While the invention has been described with reference to the structures disclosed herein, it is not confined to the details set forth and this application is intended to cover such modifications or changes as may come within the purpose of the improvements or the scope of the following claims.

What is claimed is:

1. A developing method comprising the steps of:

applying for a predetermined duration $t_1$ to a developer carrying member, facing an image bearing member for bearing an electrostatic image before formation of a developed image, for carrying a developer, a back-transfer voltage $V_1$ for returning the developer carrying member;

applying for a predetermined duration $t_2$ to the developer carrying member a transfer voltage $V_2$ for transferring the developer from the developer carrying member to the image bearing member;

shifting from the back-transfer voltage $V_1$ to the transfer voltage $V_2$, substantially in rectangular profile;

shifting from the transfer voltage $V_2$ to the back-transfer voltage $V_1$, taking a predetermined duration $t_3$, wherein $t_3$ does not substantially equal 0.

2. An method according to claim 1, wherein the predetermined duration $t_3$ is 30–10% of a period T of the voltage applied to the developer carrying member.

3. An method according to claim 1, wherein the duration $t_1$ and the duration $t_2$ are substantially the same.

4. An method according to claim 1, wherein the duration $t_2$ is not less than 15% of the period T of the voltage applied to the developer carrying member.

5. An method according to claim 1, wherein an image on the image bearing member has an image portion potential of $V_D$ and a non-image portion potential of $V_L$, and the duration in which a developer charged to a regular polarity is deposited to a $V_D$ portion is larger than 50% of the period T of the voltage applied to the developer carrying member, and a duration in which a developer charged to a polarity opposite from the regular polarity of the developer is smaller than 50% of the period.

6. An method according to claim 1, wherein the developer is one component magnetic toner.

7. A developing method comprising the steps of:

applying to a developer carrying member, facing an image bearing member for bearing an electrostatic image before formation of a developed image, for carrying a developer, a back-transfer voltage $V_1$ for returning the developer to the developer carrying member; and applying to the developer carrying member a transfer voltage for transferring the developer from the developer carrying member to the image bearing member, wherein the duration of the application of the transfer voltage to develop a low density portion on the image bearing member is less than 50% of a period T of a voltage applied to the developer carrying member, and the duration of the application of the transfer voltage to develop a high density portion on the image bearing member is not less than 50% of the period T.

8. An method according to claim 7, wherein the time required for shifting from a peak of the transfer voltage to a peak of the back-transfer voltage is longer than the time required for shifting from the peak of the back-transfer voltage to the peak of the transfer voltage.

9. An method according to claim 7, wherein the duration of the application of the transfer voltage to develop the low density portion on the image bearing member is less than 45% of the period T, and duration of the application of the transfer voltage to develop the high density portion is not less than 55% of the period T.

10. An method according to claim 7, wherein a change rate of the voltage decreases toward a peak of the back-transfer voltage from a peak of the transfer voltage.

11. An method according to claim 7, wherein a change rate of the voltage is constant in the shifting from a peak of the back-transfer voltage to a peak of the transfer voltage.

12. An method according to claim 7, wherein a change rate of the voltage exponentially changes toward a peak of the back-transfer voltage from a peak of the transfer voltage.

13. An method according to claim 7, wherein the developer is one component.

14. An method according to claim 13, wherein an absolute value of an average charging amount of the toner on the developer carrying member is not more than 15 μC/g.

15. An method according to claim 13, wherein the toner is a magnetic toner.

* * * * *

UNITED STATES PATENT AND TRADEMARK OFFICE

CERTIFICATE OF CORRECTION

PATENT NO. : 5,753,398

DATED : May 19, 1998

INVENTOR(S) : YOSHITO MIZOGUCHI

It is certified that error appears in the above-identified patent and that said Letters Patent is hereby corrected as shown below:

COLUMN 1:

Line 35, "to" should be deleted.

COLUMN 2:

Line 19, "1.57:3.14" should read --1.57;3.14--;
Line 25, "tone," should read --toner,--;

Line 47, "will" should read --will now--.

COLUMN 3:

Line 52, "half-tone" should read --half-tone image--.

COLUMN 4:

Line 8, "return" should read --returns--;
Line 28, "versely" should read --versely,--; and
Line 33, "principle" should read --principal--.

COLUMN 5:

Line 9, "a as" should read --a bias--;
Line 32, "vs. The" should read --vs. the--;
Line 43, "EMBODIMENT" should read --EMBODIMENTS--;
Line 58, "plate" should read --plate;--; and
Line 59, "6 is" should read --6 denotes--.

UNITED STATES PATENT AND TRADEMARK OFFICE

CERTIFICATE OF CORRECTION

PATENT NO. : 5,753,398

DATED : May 19, 1998

INVENTOR(S) : YOSHITO MIZOGUCHI

It is certified that error appears in the above-identified patent and that said Letters Patent is hereby corrected as shown below:

COLUMN 6:

Line 65, "a less" should read --less-.

COLUMN 7:

Line 55, "arid" should read --and--.

COLUMN 8:

Line 46, "approx." should read --approximately--;
Line 47, "prescription of" should be deleted; and
Line 57, "having" should read --which has--.

COLUMN 10:

Line 48, "the that" should read --that--.

COLUMN 11:

Line 12, "150V" should read --150V.--;
Line 15, "slight" should read --slightly--;
Line 20, "parameter," should read --parameters,--; and
Line 50, "sleeve" should read --sleeve.--. (2nd occurrence)

UNITED STATES PATENT AND TRADEMARK OFFICE

CERTIFICATE OF CORRECTION

PATENT NO. : 5,753,398

DATED : May 19, 1998

INVENTOR(S) : YOSHITO MIZOGUCHI

It is certified that error appears in the above-identified patent and that said Letters Patent is hereby corrected as shown below:

COLUMN 12:

Line 14, "namely," should be deleted; and
Line 15, "to" should be deleted.

COLUMN 13:

Line 17, "When," should read --When--; and
Line 67, "slight" should read --slightly--.

COLUMN 14:

Line 11, "magnetic" should read --the magnetic--;
Line 16, "have" should read --has--;
Line 29, "is" should be deleted; and
Line 38, "at" should read --and--.

COLUMN 15:

Line 36, "are" should be deleted;
Line 39, "slight" should read --slightly--; and
Line 45, "the" (second occurrence) should be deleted.

COLUMN 16:

Line 11, "different" should read --difference--; and
Line 20, "embodiment" should read --embodiment.--.

UNITED STATES PATENT AND TRADEMARK OFFICE

CERTIFICATE OF CORRECTION

PATENT NO. : 5,753,398

DATED : May 19, 1998

INVENTOR(S) : YOSHITO MIZOGUCHI

It is certified that error appears in the above-identified patent and that said Letters Patent is hereby corrected as shown below:

COLUMN 17:

```
Line 4, "profile;" should read --profile; and--;
Line 8, "An" should read --A--;
Line 11, "An" should read --A--;
Line 13, "An" should read --A--;
Line 16, "An" should read --A--; and
Line 25, "An" should read --A--;
```

COLUMN 18:

```
Line 8, "An" should read --A--;
Line 13, "An" should read --A--;
Line 19, "An" should read --A--;
Line 22, "An" should read --A--;
Line 25, "An" should read --A--;
Line 28, "An" should read --A--;
Line 30, "An" should read --A--; and
Line 33, "An" should read --A--;
```

Signed and Sealed this

Sixteenth Day of February, 1999

*Attest:*

*Attesting Officer*

*Acting Commissioner of Patents and Trademarks*